US006487776B2

(12) United States Patent
Chang

(10) Patent No.: US 6,487,776 B2
(45) Date of Patent: Dec. 3, 2002

(54) HANDHELD AND BENCH TOP HOSE AND TUBING CUTTER

(76) Inventor: Wen-Lung Chang, 2309 Ray Dr., Burlingame, CA (US) 94010

( * ) Notice: Subject to any disclaimer, the term of this patent is extended or adjusted under 35 U.S.C. 154(b) by 0 days.

(21) Appl. No.: 09/836,143

(22) Filed: Apr. 16, 2001

(65) Prior Publication Data

US 2002/0148118 A1 Oct. 17, 2002

(51) Int. Cl.[7] ..... B26B 13/00
(52) U.S. Cl. ..... 30/92; 30/258
(58) Field of Search ..... 30/92, 258, 253, 30/191

(56) References Cited

U.S. PATENT DOCUMENTS 1,085,793 A * 2/1914 Boettger ..... 30/253
4,434,555 A * 3/1984 Stoll ..... 30/92

* cited by examiner

*Primary Examiner*—Douglas D. Watts
(74) *Attorney, Agent, or Firm*—Pacific Law Group LLP; Chi Ping Chang

(57) ABSTRACT

A handheld and bench top hose and tubing cutter for cutting hose and tubing of various sizes is disclosed. The hose cutter comprises a upper arm member and lower arm member with each arm member having its own handle, finger guard and colored differently. An intermediate pivot point is located close to one end of each of the two arm members to join the two arm members. The upper arm member further comprises a replaceable cutting blade located close to the pivot point. The lower arm member further comprises a nested cradle facing the cutting blade. The nested cradle has a suitably contoured supporting surface for the positioning of a hose or tube of various sizes to be engaged and cut through by the cutting blade. The upper and lower arm member also respectively includes opposing stopping surfaces such that, upon contacting each other, they would act as a positive stop for the cutting process with the position of the cutting blade clearing the nested cradle. Additionally, the upper and lower arm member respectively includes opposing limiting surfaces close to the pivot point to guarantee a maximum opening angle between the upper and lower arm member for the avoidance of the danger of exposing the cutting blade.

5 Claims, 6 Drawing Sheets

HANDHELD AND BENCH TOP HOSE AND TUBING CUTTER

FIELD OF THE INVENTION

This invention is related to a device for cutting small to large sized and reinforced rubberized tubing. More particularly, the invention deals with such a device functioning both as a hand held and a bench top tool. Some applications are the cutting of radiator hoses in an automotive repair shop or the cutting of certain plastic tubing for plumbing work.

BACKGROUND OF THE INVENTION

The need of thus the existence of prior art and associated devices for cutting a variety of tubing has been around for many years. For example, both Canadian Patent No. 1,178,426 and U.S. Pat. No. 5,987,750 disclosed a scissors type of tube cutter including two arms connected in their middle points and operating with a scissors like action. One end of the arms consists of a pair of opposing jaws. One of the jaws has a tube-shaped support surface that positions a tube for engagement by a blade held by the other jaw. Both of the disclosed devices have been commercialized and have been useful in cutting reinforced rubberized tubes. However, the manufacturers of these two devices typically limit the outside diameter of tubes to be cut to 1.5" or smaller (Lisle Catalog 2000, page 50; S & G Tool Aid Catalog, page 41; Snap On Catalog 2000, page E-33; Mac Tool Catalog 2000, Page 310; Matco Catalog 1998–1999, page 182). These devices are not useful in cutting reinforced radiator hoses of larger sizes from 2" to 2.5" in outside diameter. This inventor has experimented with an enlarged version of the scissors design as mentioned above and has found four major limitations of such a design for cutting large sized tubes:

1. The cutting device has to be 24" or longer in order to achieve enough leverage to cut a tough reinforced radiator tube of diameter in the range of 2"–2.75". Thus, it is too large to be of practical use for an auto mechanic.
2. While these devices all use a sharp pointed blade thus having a very small contact area for the penetration and cutting of a reinforced tube, some of the larger sized radiator hoses are much more flexible than the smaller ones. Thus, the surface deformation of the larger sized radiator hoses results in a large area of contact with the blade. Consequently, the larger sized radiator hoses still make the cutting more difficult.
3. When cutting a hose near its end, the surface near the end is less rigid thus it flexes more than the surface of the longer portion of the hose. The uneven flexing of the hose straddling the blade tends to force the blade thus the device to bend toward the side that flexes less (the longer side of the hose). As a consequence, the bent blade either fails to cut properly or can not cut at all.
4. Yet another draw back of the large scissors design is that it has to be operated by two hands. Consequently, an operator does not have a spare hand to hold the hose in proper position to be cut.

U.S. Pat. No. 4,412,380 (Kish, 1983) discloses a cutter for air conditioning hoses. The device comprises a base that is provided with axially spaced and axially aligned tubes for the reception of the hose to be cut. The device further consists of a manually operable handle that is pivotally secured to the base and a cutter blade that is movable through the hose to sever the hose into a desired length. As such, the device is designed toward an application wherein it is to be mounted on the top of a workbench, not a portable tool. It can not be easily used as a convenient hand held tool. Furthermore, the device employs an axially spaced and axially aligned tube to hold the hose to be cut. Therefore, the size of the holding tube needs to be fairly close to that of the hose to be cut. As the holding tube is an integral part of the device, a user needs to maintain several cutters having different sized holding tubes to cover a wide range of hose sizes. This is rather expensive and inconvenient.

SUMMARY OF THE INVENTION

In light of the various drawbacks of the prior art as explained above, the present invention is directed to an improved hose cutter.

It is an objective of this invention to devise a compact, portable and hand held hose cutter that is small enough to be stored in a mechanic's tool box.

The second objective of this invention is to have the subject hose cutter capable of cutting a large sized radiator hose as well as smaller sized tubes or hoses.

The third objective of this invention is to make the subject hose cutter also functional as a bench top or floor model, whereby an operator would operate the cutter with one hand while holding the hose to be cut with another hand.

Other objectives, together with the foregoing are also attained in the exercise of the invention as described in the following description and resulting in the embodiment illustrated in the accompanying drawings.

BRIEF DESCRIPTION OF DRAWINGS

The current invention will be better understood and the nature of the objectives set forth above will become apparent when consideration is given to the following detailed description of the preferred embodiments. For clarity of explanation, the detailed description further makes reference to the attached drawings herein.

DETAILED DESCRIPTION OF PREFERRED EMBODIMENTS

Figure 1:
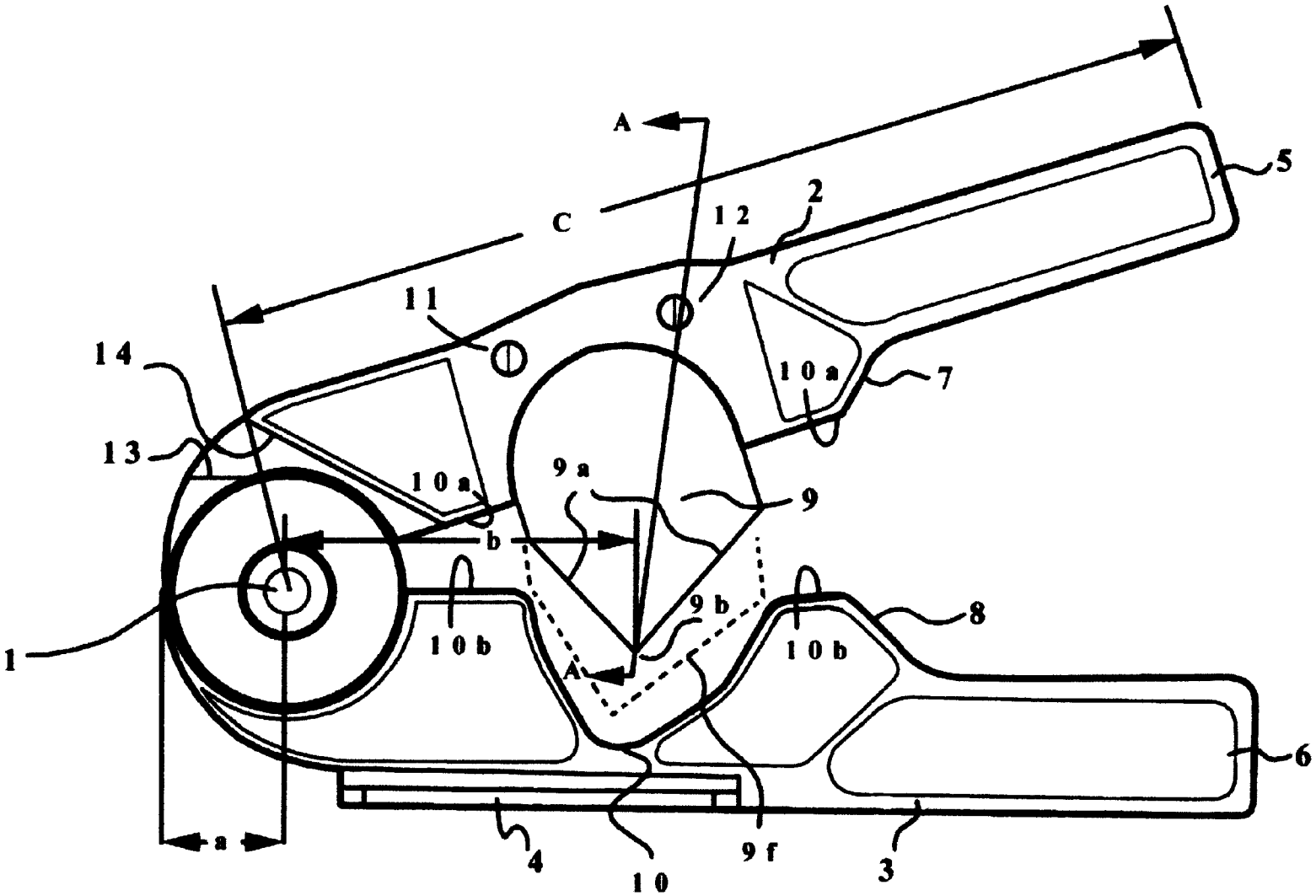
FIG. 1 is a side view of the current invention.

In the following detailed description of the present invention, numerous specific details are set forth in order to provide a thorough understanding of the present invention.

However, it will become obvious to those skilled in the art that the present invention may be practiced without these specific details.

Reference herein to "one embodiment" or an "embodiment" means that a particular feature, structure, or characteristics described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments.

A typical hand held automotive hose cutter includes two scissors-like arms joining at a pivot point located along the respective length of the arms. The arms have opposing jaws with one of these jaws further including a cutter blade while the other jaw providing a support surface for holding the hose to be cut. With the arms squeezed, the cutter blade pierces and cuts through the hose. However, this type of design is not suitable for cutting large diameter radiator hoses where a scissors type hose cutter would have to be made impracticably long to provide sufficient leverage for cutting.

Reference is made to FIG. 1, FIG. 2, FIG. 3*a* and FIG. 3*b*. An upper arm member 2 and a lower arm member 3 are rotatably joined at a pivot point 1. Upper arm member 2 includes an upper handle 5 and blade mounting screws 11 and 12 for fixedly holding a removable cutting blade 9. Lower arm member 3 includes a lower handle 6 and a nested cradle 10. Cutting blade 9 includes a piercing point 9*b* and cutting edges 9*a* for piercing and cutting through a hose (not shown in FIG. 1). Mounting holes are provided on cutting blade 9 to match blade-mounting screws 11 and 12 although they are not shown here for simplicity and as they are well known in the art. Additionally, upper arm stopping surfaces 10*a* and their corresponding lower arm stopping surfaces 10*b* are provided such that, upon contacting each other, they would act as a positive stop for the process of cutting wherein upper arm member 2 and lower arm member 3 are rotatably squeezed toward each other centering around pivot point 1 and via their respective upper handle 5 and lower handle 6. Thus, at the end of the cutting process, the closed position of cutting blade 9*f* (dashed lines) will definitely clear nested cradle 10 as indicated. As a safety feature, upper finger guard 7 and lower finger guard 8 are respectively provided on upper arm member 2 and lower arm member 3 to prevent the fingers of an operator from reaching the dangerous area of cutting blade 9 during the cutting process. Likewise, upper arm limiting surface 14 and lower arm limiting surface 13 are also provided respectively on upper arm member 2 and lower arm member 3 and their function will be presently described. Lower arm member 3 includes additional fixed stabilizing wings 4 whose function will also be presently described. For maximum material strength while keeping the weight of the hose cutter light, a preferred material of cast Aluminum is used for upper arm member 2 and lower arm member 3 although other materials like cast iron, steel, brass and Titanium can be used as well.

Given a fixed maximum squeezing force available at upper handle 5 and lower handle 6, it is desirable to generate the maximum possible piercing force at piercing point 9*b* so that hoses of maximum possible diameter and strength can be cut through. As the pivot point, or center of relative rotation between upper arm member 2 and lower arm member 3 is located at the pivot point 1, the following Leverage Factor is the most important parameter to maximize:

$$\text{Leverage Factor}=c/b,$$

Where "c" is the distance from pivot point 1 to upper handle 5 and "b" is the distance from pivot point 1 to piercing point 9*b*. Since practically "c" is already limited to a value of around 10"–13" for a compact, portable and hand held device storable in a mechanic's tool box, it is important to minimize distance from pivot point to piercing point 9*b*. However, there are many design factors that prevent "b" from getting too small. For example, the distance from pivot point 1 to front end of cutter "a" needs to have some significant value for sufficient strength of the pivot structure. Another factor is that, with the angle between upper arm member 2 and lower arm member 3 opened up to its maximum value, a minimum opening between piercing point 9*b* and nested cradle 10 is required to accommodate a required maximum size of hose to be cut. As a result, a compromised design value of 2.5"–3.5" is selected for "b" while achieving sufficient leverage for the cutting of a 2.5" diameter radiator hose with an overall device length of 11"–13" and a maximum opening angle of less than 90 degrees.

Figure 2:
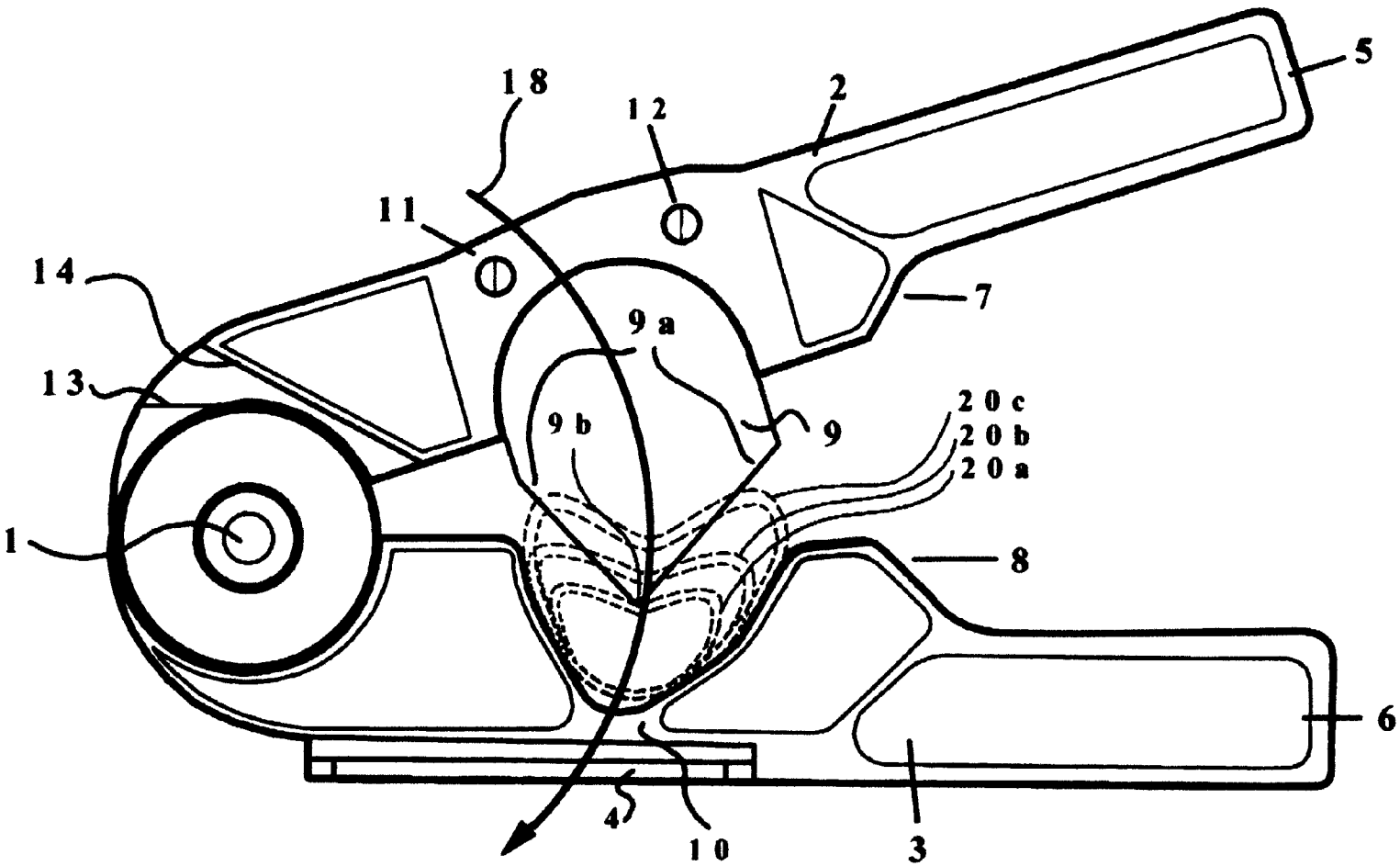
FIG. 2 is another side view of the current invention wherein a number of hoses of different sizes are included.

Another important embodiment of the current invention is the detailed contour of nested cradle 10 shown in FIG. 2. Also illustrated here are cross section of small hose at instant of piercing 20*a*, cross section of medium hose at instant of piercing 20*b*, cross section of large hose at instant of piercing 20*c* and arcuate trajectory of piercing point 18 of cutting blade 9. Notice that, for each of the three cases of different hose diameter, the corresponding piercing point always lies close to the center of the hose resulting in a most effective piercing action. Additionally, nested cradle 10 is made sufficiently deep such that the surface deformation of even the larger sized radiator hoses is constrained to a degree that alleviates the previously mentioned difficulty coming from a large area of contact with the blade following excessive deformation of the hose. These features of the current invention come from the unique contouring of nested cradle 10 that has to be empirically determined as many of the variety of hoses still go through some degree of elastic deformation before the instant of piercing by piercing point 18 of cutting blade 9.

Figure 3A:
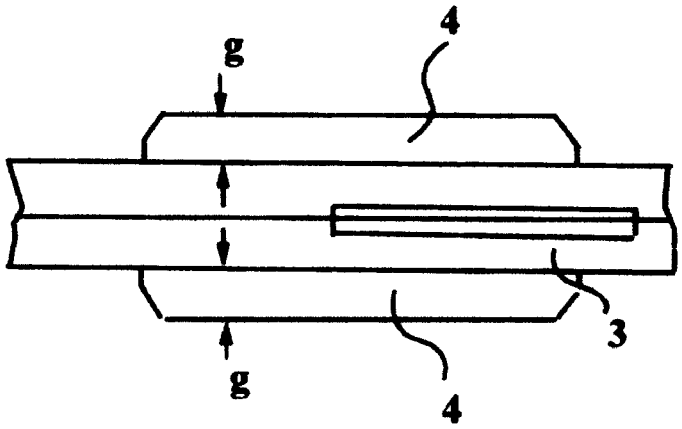
FIG. 3*a* is a top view of a structure of fixed stabilizing wings employed as part of the current invention.
Figure 3B:
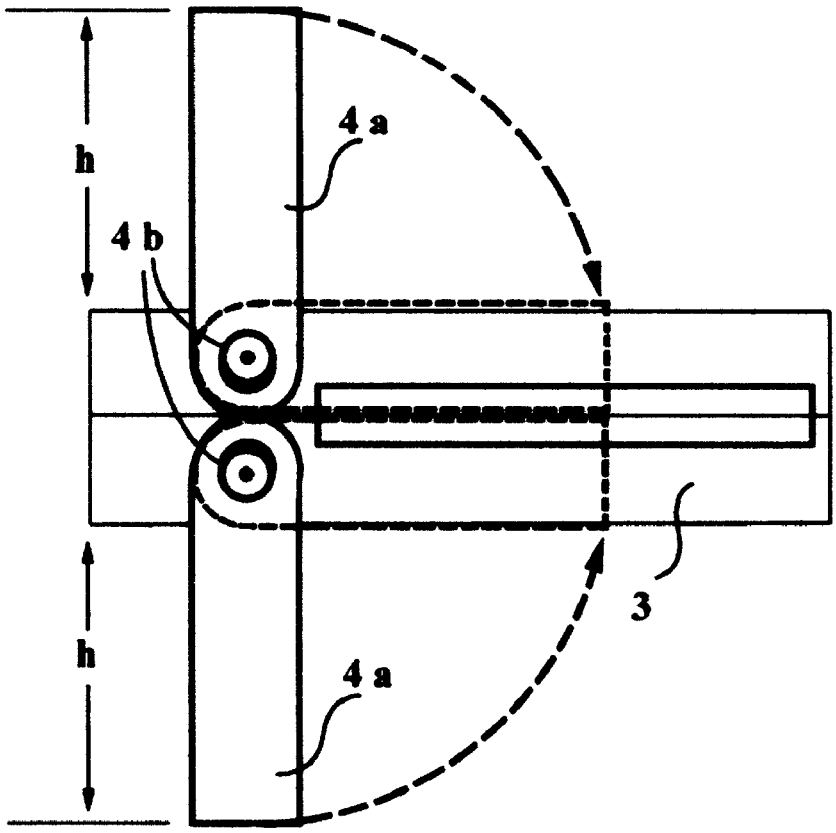
FIG. 3*b* is a top view of an alternative structure of foldable stabilizing wings employed as part of the current invention.

FIG. 3*a* is a top view of a section of lower arm member 3 illustrating an embodiment of fixed stabilizing wings employed as part of the current invention. As shown, fixed stabilizing wings 4 having lateral width g are included as part of the body of lower arm member 3. Additionally, fixed stabilizing wings 4 lie in a plane generally perpendicular to the plane of lower arm member 3. As mentioned before, when cutting a hose near its end, the uneven flexing of the hose straddling the blade tends to force the blade thus the device to bend toward the side that flexes less and causes difficulty or failure of cutting. Therefore, with fixed stabilizing wings 4 resting and firmly pressing against a flat surface as would be the case when the device of the current invention is used as a bench top or floor model, fixed stabilizing wings 4 will act to resist such tendency of bending thus reducing or eliminating this problem. By the same token, fixed stabilizing wings 4 also serve to keep the hose to be cut perpendicular to the cutting blade and this is also critical to the achievement of a quality cut. In fact, the more the lateral width g is the more effective the solution will be. On the other hand, as the device of the current invention also needs to function as a hand held tool, the choice of lateral width g has to be compromised to within a practical limit of 0.25"–1". In view of this limitation, an alternative embodiment with foldable stabilizing wings 4*a* having hinge points 4*b* is illustrated in FIG. 3*b*. In this way, the lateral width of foldable stabilizing wing h can be made much longer than lateral width g of fixed stabilizing wings 4 before. However, after the foldable stabilizing wings 4*a* are folded underneath lower arm member 3 (see dashed lines and arrows) they become unobtrusive and the device can function as a hand held tool again.

Figure 4:
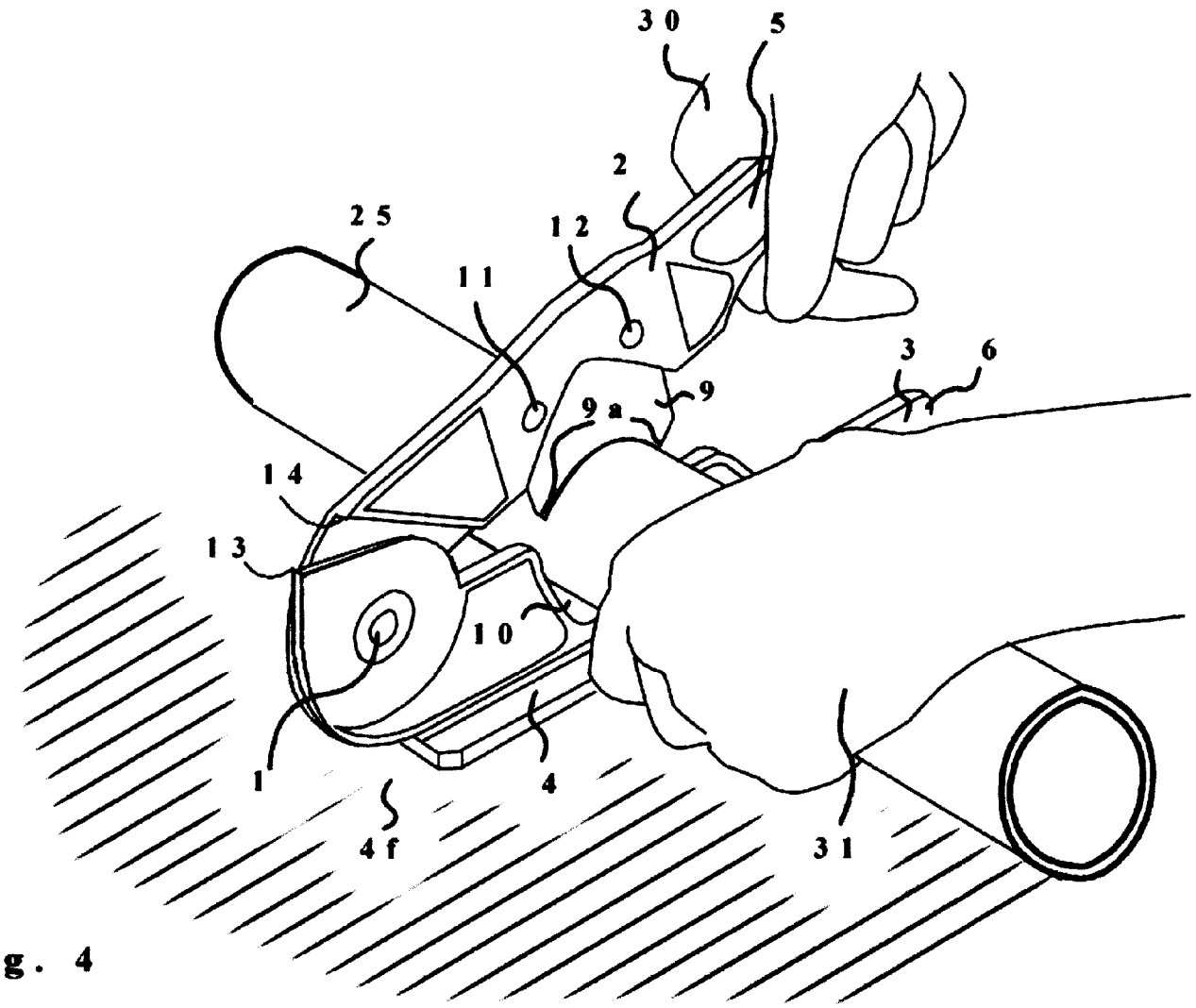
FIG. 4 is a perspective illustration of an application of the current invention as a bench top or floor model wherein an operator would operate the cutter of the current invention with one hand while holding the hose to be cut with another hand.

FIG. 4 is an exemplary drawing illustrating the advantage of using the hose cutter of the current invention as a bench top or floor level hose cutter. One hand on upper handle of cutter 30 is pressing down on upper handle 5 of upper arm member 2 while the other hand holding section of hose being cut 31 is holding and stabilizing section of hose being cut 25. This is especially important while cutting a large diameter or long section of hose or PVC pipe. Notice that fixed stabilizing wings 4 are pressed against a flat work surface 4*f* and thus serving the function of resisting the tendency of bending of the hose cutter with its associated problem, as stated before. Additionally, there is upper arm limiting surface 14 located on upper arm member 2 and in close proximity to pivot point 1. Correspondingly, there is lower arm limiting surface 13 located on lower arm member 3 and also in close proximity to pivot point 1. As upper arm member 2 rotatably opens up with respect to lower arm member 3 the subtended angle would reach a maximum value where further increase of the subtended angle is prohibited by the contact of upper arm limiting surface 14 and lower arm limiting surface 13. This serves to limit the opening between the two arm members to avoid the danger of exposing the sharp cutting blade 9. On the other hand, the opening between the two arm members does need to be wide enough to accommodate the maximum sized hose to be cut. In practice, as stated before, a maximum opening angle of less than 90 degrees is chosen as a compromise.

Figure 5A:
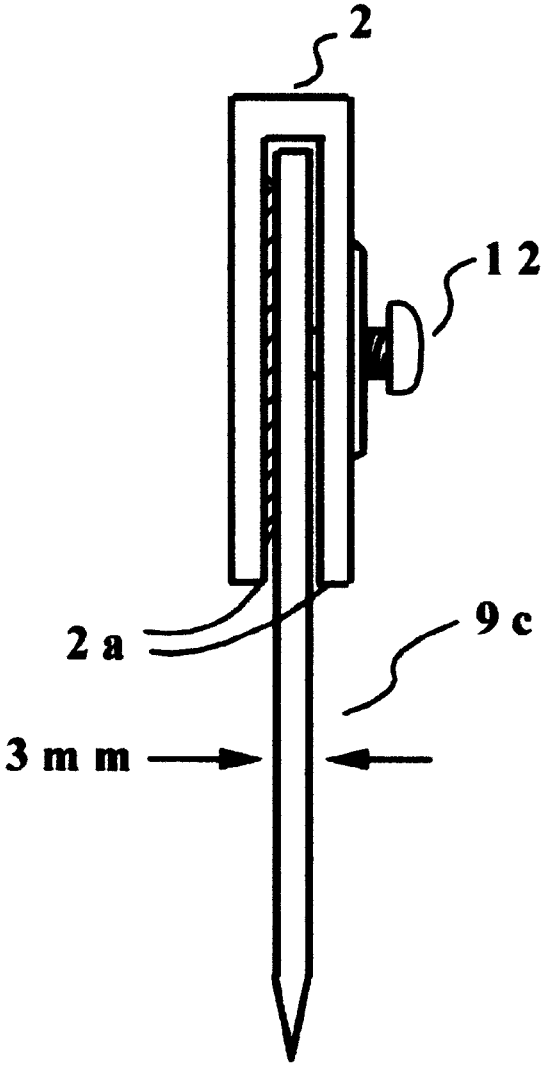
FIG. 5*a* is an end view of a section of upper arm member illustrating the fixing of a thick cutting blade into the hose cutter of the current invention.

FIG. 5*a* is an end view of a section A—A of upper arm member 2 illustrating the fixing of a replaceable thick cutting blade 9*c* into the hose cutter of the current invention. A thick cutting blade 9*c*, being 3 mm in thickness, is fixedly mounted against a slot 2*a* of upper arm member 2 with blade mounting screw 12 and blade mounting screw 11 (not visible in this sectional view). For cutting rubberized radiator hose, thick cutting blade 9*c* is needed such that the rigidity of the blade body will prevent itself from bending deformation, especially under the situation where the surface of the hose flexes unevenly. Furthermore, the rubberized radiator hose is sufficiently soft thus it yields easily to the thick blade during cutting.

Figure 5B:
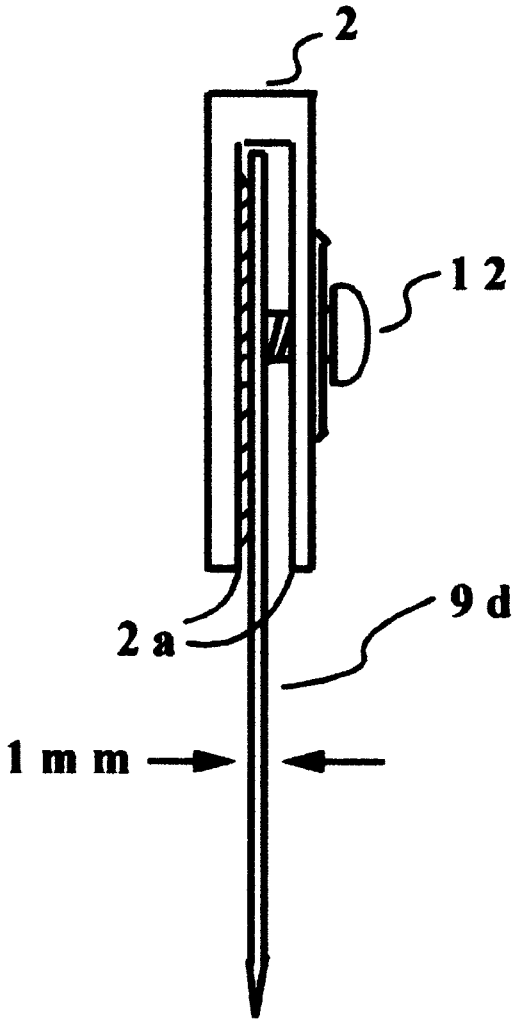
FIG. 5*b* is an end view of a section of upper arm member illustrating the fixing of a thin cutting blade into the hose cutter of the current invention.

However, for cutting a much harder PVC or ABS tubing that would only yield a little, a very thin (0.7 mm–1 mm) cutting blade should be used instead as it would go through the tubing easily without causing any damage to the cut end. This is illustrated in FIG. 5*b* showing an end view of a section A—A of upper arm member 2 wherein a replaceable thin cutting blade 9*d*, being 1 mm in thickness, is fixed into the hose cutter of the current invention with further advancement of blade mounting screw 12 and blade mounting screw 11 (not visible in this sectional view).

Figure 6:
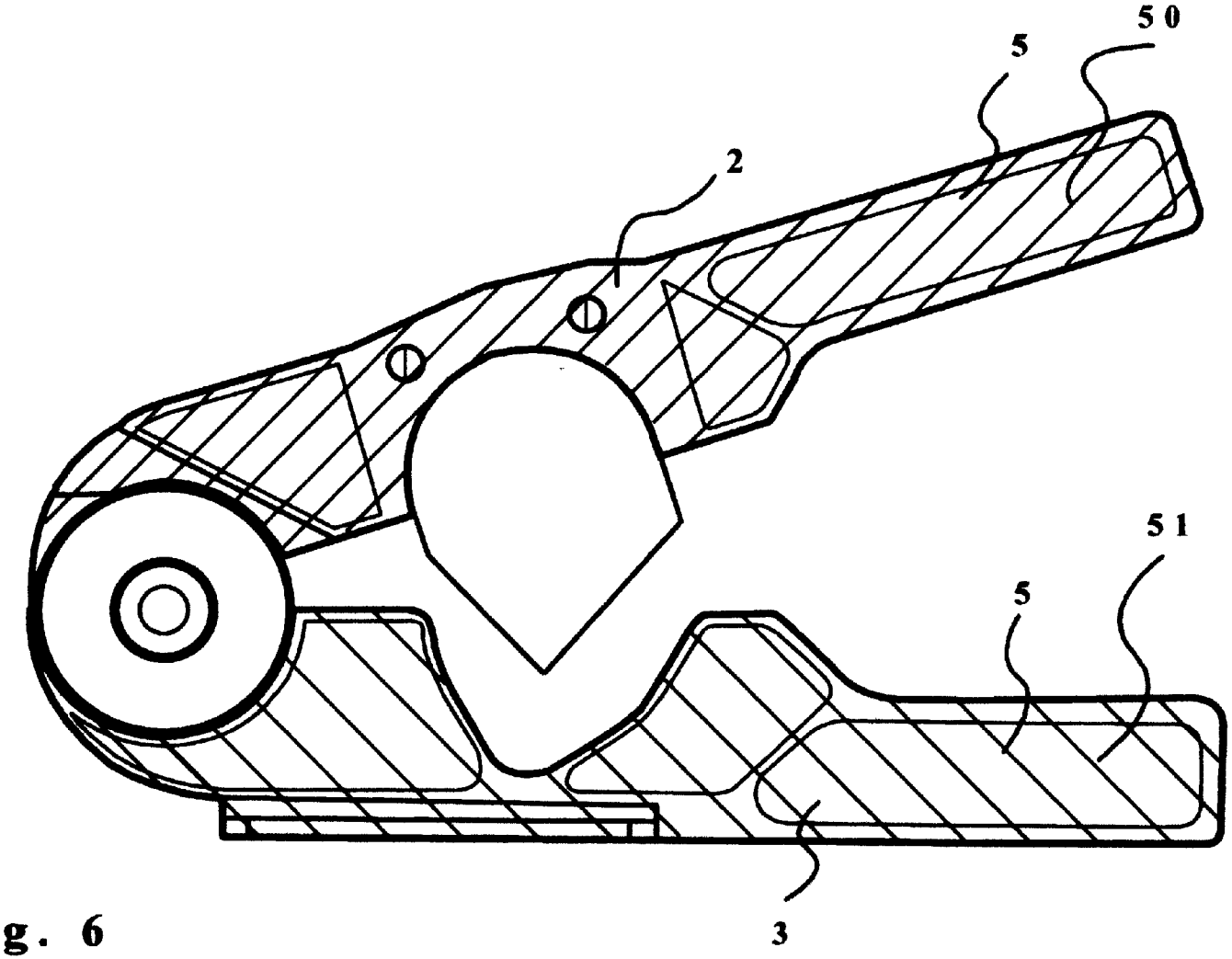
FIG. 6 is a third side view of the current invention wherein the different coloring of the upper arm member and the lower arm member is illustrated.

FIG. 6 is a third side view of the hose cutter illustrating another embodiment of the current invention wherein upper arm member 2 and lower arm member 3 are painted red (50) and gray (51) respectively. The advantage of using a two-tone coloring scheme is that it allows a user to quickly differentiate the handles for proper pick up. This is especially important when the hose cutter is used as a bench top or floor model where lower arm member 3 must be placed against a working surface and upper arm member 2 must be operated by hand.

A hose cutter is described that functions both as a hand held and bench top or floor model for cutting hose and tubing of a range of sizes. The invention has been described using exemplary preferred embodiments. However, for those skilled in this field, the preferred embodiments can be easily adapted and modified to suit additional applications without departing from the spirit and scope of this invention. Thus, it is to be understood that the scope of the invention is not limited to the disclosed embodiments. On the contrary, it is intended to cover various modifications and similar arrangements based upon the same operating principle. The scope of the claims, therefore, should be accorded the broadest interpretations so as to encompass all such modifications and similar arrangements.

I claim:

1. A compact, hand held device for cutting hose and tubing of a range of sizes comprising:

an upper arm member and a lower arm member with a first end of each member being a handle, respectively called an upper handle and a lower handle, wherein a second end of both of these two arm members are rotatably joined at a pivot point;

a cutting blade replaceably fixed to said upper arm at a position closer to said pivot point than said upper handle to ensure a minimum opening between said arm members required to accommodate the hose and tubing to be cut;

a nested cradle on said lower arm member facing opposite the cutting blade of said upper arm member wherein said nested cradle having a suitably shaped supporting surface for receiving the hose and tube to be cut by said cutting blade;

an upper arm stopping surface and a lower arm stopping surface facing opposite each other respectively on said upper and lower arm members such that, upon contacting each other, said upper arm stopping surface and said lower arm stopping surface act as a positive stop to ensure the clear of said cutting blade from said nested cradle at the end of a cutting operation;

an upper arm limiting surface and a lower arm limiting surface located opposing each other on said upper and lower arm members in close proximity to said pivot point such that the contact between the upper arm limiting surface and the lower arm limiting surface defines a maximum opening angle between said upper and lower arm members to avoid excessive exposure of said cutting blade when the upper arm member rotatably opens up with respect to the lower arm member; and a number of stabilizing wings located on an outside edge of said lower arm member near the pivot point and in parallel to the base of said lower arm member, allowing said device to be stabilized against a bench top or floor while keeping the hose to be cut perpendicular to the cutting blade thereby reducing undesirable bending of said device whereby the overall length of the said device is at least 30 percent less than that of a typical device of a 24" scissors type design with similar cutting strength, thus said device can be stored in a mechanic's tool box while capable of cutting a large radiator hose of diameters in the range of 2.0"–2.75" with a maximum opening angle of less than 90 degrees.

2. A compact, hand held device for cutting hose and tubing according to claim 1 wherein said stabilizing wings are foldable and extendable to provide wider footprint and additional stabilization to the device.

3. A compact, hand held device for cutting hose and tubing according to claim 1 further comprises a contour on said nested cradle of the lower arm member to provide a close alignment of the cutting blade with a center of the hose to ensure an effective piercing action.

4. A compact, hand held device for cutting hose and tubing according to claim 3 wherein said nested cradle has a depth sufficient to accommodate hoses of different sizes to reduce surface deformation of the hose to be cut.

5. A compact, hand held device for cutting hose and tubing according to claim 1 wherein said upper arm member further comprises a slot with a number of adjustable screws for the accommodation of replaceable cutting blades of a range of different thickness.

* * * * *